US005924811A

United States Patent [19]

To et al.

[11] Patent Number: 5,924,811

[45] Date of Patent: Jul. 20, 1999

[54] ASSEMBLING AND DISASSEMBLING DEVICE FOR RING BINDERS

[75] Inventors: Chun Yuen To, New Territories; Chun On William To, Kowloon; Weng Io Ng, Quarry Bay; Kung Cheng, An Qing City; Wen-Ming Xu, Huai Nan City, all of The Hong Kong Special Administrative Region of the People's Republic of China

[73] Assignee: World Wide Stationery Mfg. Co., Ltd., New Territories, The Hong Kong Special Administrative Region of the People's Republic of China

[21] Appl. No.: 08/903,411

[22] Filed: Jul. 30, 1997

[51] Int. Cl.[6] ..... B42F 13/00

[52] U.S. Cl. ..... 402/26; 402/70; 402/73; 402/75

[58] Field of Search ..... 402/70, 73, 75, 402/80 R, 26; 281/19.1, 29, 34, 36, 37; 411/467, 468, 348

[56] References Cited

U.S. PATENT DOCUMENTS

| | | | |
|---|---|---|---|
| 1,895,972 | 1/1933 | Childs . | |
| 3,252,461 | 5/1966 | Schade . | |
| 4,582,422 | 4/1986 | Rager . | |
| 5,120,149 | 6/1992 | Smith . | |
| 5,160,209 | 11/1992 | Schuessler . | |
| 5,348,412 | 9/1994 | Fuller . | |
| 5,354,142 | 10/1994 | Yu . | |
| 5,755,513 | 5/1998 | To | 402/36 |
| 5,772,348 | 6/1998 | To | 402/36 |

OTHER PUBLICATIONS

Bindertek Lawfiles Catalog; "It's About Time"; Bindertek Eurofiles and Lawfiles Systems, 20 pages.

*Primary Examiner*—Frances Han

*Attorney, Agent, or Firm*—Birch, Stewart, Kolasch & Birch, LLP

[57] ABSTRACT

A fastener apparatus for releasably fastening a sheet retaining apparatus to a cover member includes a plate member secured to the cover member and having an aperture therein. A pin member is reciprocally mounted to the sheet retaining apparatus, with a portion of the pin member being selectively positionable in the aperture to secure the sheet retaining apparatus to the cover member. Thus, the sheet retaining apparatus is readily assemblable and disassemblable from the cover member repeatedly by a user. Thus, the sheet retaining apparatus and the cover member may be shipped in an unassembled condition in a very compact package for later assembly by the consumer.

28 Claims, 4 Drawing Sheets

ASSEMBLING AND DISASSEMBLING DEVICE FOR RING BINDERS

BACKGROUND OF THE INVENTION

1. Field of the Invention

The present invention relates to a ring binder assembly, and more particularly, to a fastener assembly for releasably fastening a sheet retaining apparatus to a binder cover to form the ring binder.

2. Description of the Background Art

Various ring binders are known in the art which have a paper retaining device attached to a cover member by a plurality of rivets which extend through the cover member and which are deformed, for example, by punching, to securely and permanently fix the paper retaining device to the cover member.

A disadvantage associated with such conventional ring binders is that the assembling process is both laborious and prone to error. It is necessary to provide the assemblers with rivets properly sized and shaped to fit both of the corresponding holes in the paper retaining device and the cover member. The assemblers must secure the paper retaining device to the cover member by first inserting the rivet through the cover member, then through the paper retaining device, and then deforming the tail of the rivet by punching to engage the upper plate of the paper retaining device.

A further disadvantage associated with the conventional ring device is that once the paper retaining device is assembled with the cover member, it cannot be readily removed to replace the paper retaining device or the cover member in the event of failure thereof.

A still further disadvantage associated with the conventional ring binder is that the conventional ring binder is typically shipped in the assembled condition, which takes up enormous space in the packaging thereof, resulting in higher shipping costs.

SUMMARY OF THE INVENTION

Accordingly, it is an object of the present invention to provide a ring binder which minimizes the labor intensive steps associated with assembling the sheet retaining apparatus to the cover member prior to shipment.

It is a further object of the present invention to provide a fastener assembly for releasably fastening a sheet retaining apparatus to a cover member, whereby the sheet retaining apparatus may be repeatedly assembled and disassembled with the cover member utilizing the same fastener assembly.

It is yet another object of the present invention to provide a kit including a plurality of cover members and a plurality of sheet retaining members which may be packaged efficiently and shipped to a consumer for subsequent assembly by the consumer.

These and other objects of the present invention are achieved by a fastener assembly for fastening a sheet retaining apparatus to a cover member, the fastener assembly including a plate member secured to the cover member and having an aperture therein. A pin member is reciprocally mounted to the sheet retaining apparatus, with a portion of the pin member being selectively positionable in the aperture to secure the sheet retaining apparatus to the cover member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
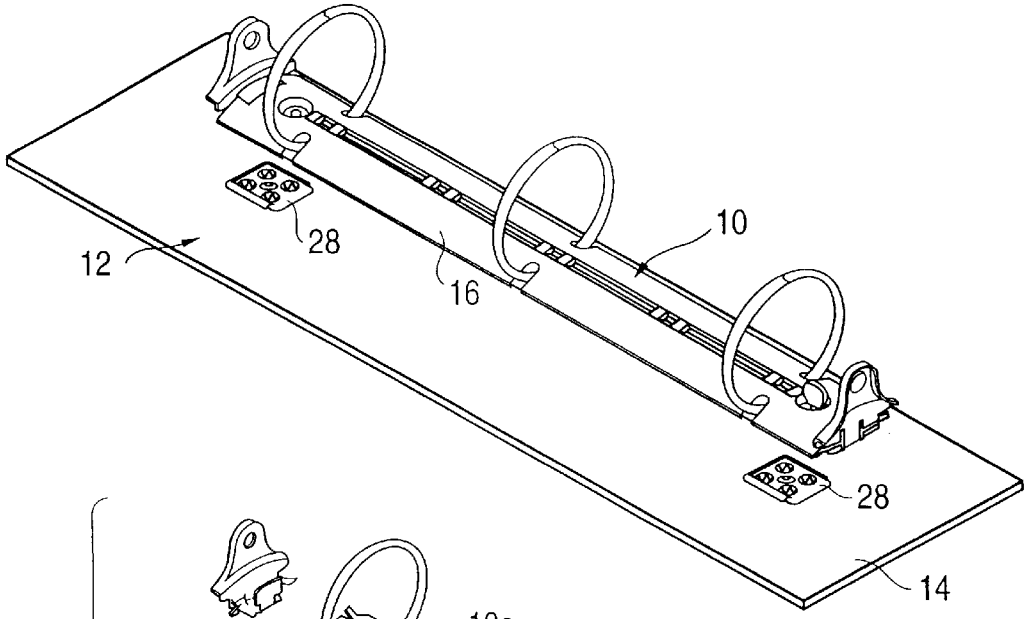
FIG. 1 is a perspective view of the ring binder in a released position.
Figure 2:
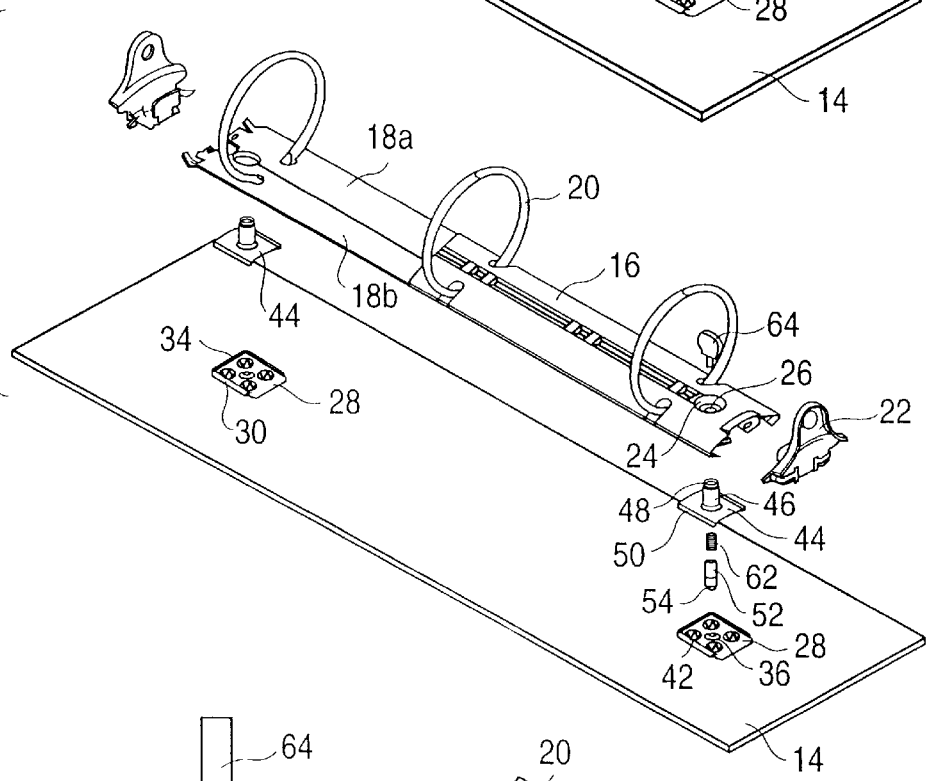
FIG. 2 is an exploded perspective view of the ring binder showing the respective elements.
Figure 3:
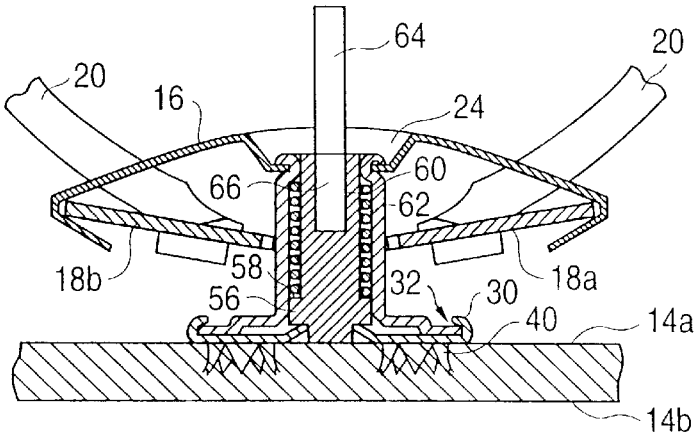
FIG. 3 is a fragmentary end view of the ring binder in an assembled condition.

Referring in detail to the drawings, and with particular reference to FIGS. 1 and 2, a ring binder of the present invention is shown. The ring binder generally includes a sheet retaining apparatus 10 and a cover member 12. The cover member 12 includes a spine 14 located between front and back covers (not shown) of the cover member 12. The spine 14 includes an inner surface 14*a* and an outer surface 14*b*, as shown in FIG. 3.

The sheet retaining apparatus 10 includes a substantially rigid curved upper plate 16 supporting a pair of hinged leaves 18*a*, 18*b*. Secured to the hinged leaves 18*a*, 18*b* are a plurality of ring members 20 for engaging corresponding holes in sheets of material retained by the sheet retaining apparatus 10. A lever 22 is located at each end of the curved upper plate 16 for actuating the hinged leaves 18*a*, 18*b* to open and close the ring members 20.

The curved upper plate 16 includes a depression 24 near each end thereof. The depression 24 includes an aperture 26 extending through the upper plate 16. The sheet retaining apparatus 10 is more fully disclosed in U.S. Pat. No. 5,354,142, the entire contents of which are hereby incorporated by reference.

A fastener assembly for releasably fastening the sheet retaining apparatus 10 to the cover member 12 will now be described in detail, with particular reference to FIGS. 2 and 3. A pair of spaced-apart plate members 28 are secured to the spine 14 of the cover member 12 in a manner to be described more fully later. Each of the plate members 28 includes a pair of spaced-apart guide members 30 which form guide channels 32. The plate members 28 each further include a stop member 34, which is more readily visible in FIG. 6.

Figure 6:
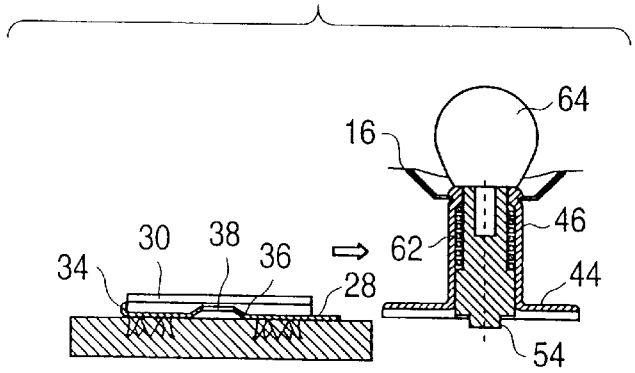

Located approximately centrally of the plate member 28 is a raised annular protrusion 36 having an aperture 38 therein, which is more readily visible in FIG. 6. Depending from a lower surface of the plate member 28 are arranged a plurality of deformable claws 40 arranged around the periphery of a plurality of holes 42 formed in the plate member 28. In the embodiment shown in FIG. 2, four holes 42 are located in the plate member 28, however, any suitable number may be utilized.

When the plate member 28 is assembled with the spine 14 of the cover member 12, the plate member 28 is pressed against the spine 14 such that the deformable claws 40 dig into the material which forms the spine. The deformable claws 40 extend outwardly somewhat in order to securely fasten the plate member 28 to the spine 14. It should be understood that while the preferred embodiment shows the plate members 28 attached to the spine 14, the plate members 28 may instead be secured to the front cover or the back cover.

A base member 44 is securely fastened to the curved upper plate 16 by a substantially cylindrical body 46 having a head 48 which extends through the aperture 26 and is securely fastened within the depression 24, for example, by pressing. The base member 44 includes a pair of spaced-apart guide rails located along opposite edges thereof. The guide rails 50 are slidable within the guide channels 32 in a manner which will be described in more detail later.

Located interiorally of the substantially cylindrical body 46 is a pin member 52. The pin member 52 includes a reduced diameter portion 54 at a lower end thereof, and an enlarged diameter portion 56 forming a shoulder 58 adjacent to the reduced diameter portion 54. The other end of the pin member 52 includes a bore 60 extending partially therein. A spring 62 is arranged between the shoulder 58 of the pin member 52 and the head 48 of the substantially cylindrical body 46, for biasing the pin member 52 away from the sheet retaining apparatus 10. A knob 64 includes a shank 66 fitted into the bore 60 of the pin member 52.

The base member 44 is assembled with the curved upper plate 16 in the following manner. The head 48 of the substantially cylindrical body 46 is inserted through the aperture 26 and securely fastened thereto by pressing. The spring 62 is placed onto the pin member 52 such that one end of the spring 62 engages the shoulder 58 of the pin member 52. The pin member 52 is then inserted into the substantially cylindrical body 46. Thereafter, the shank 66 of the knob 64 is inserted into the bore 60 of the pin member, for example, by press fitting. With the knob 64 securely fastened to the pin member 52, the knob may be pulled to reciprocally move the pin member 52 within the substantially cylindrical body 46 against the biasing force provided by the spring 62.

Figure 7:
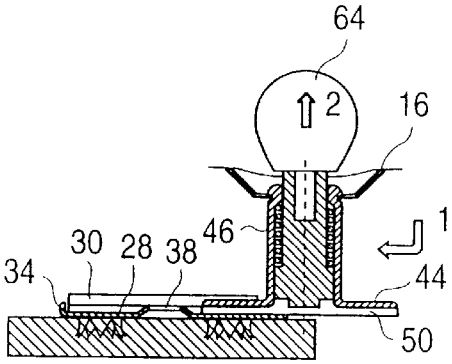
FIGS. 7 and 8 are schematic views showing the operation of the pin member to effect an assembled condition.
Figure 8:
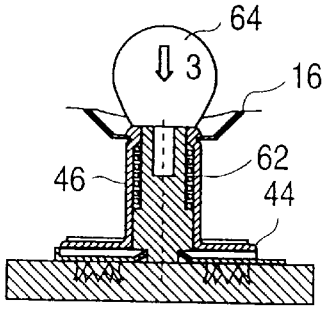
Figure 9:
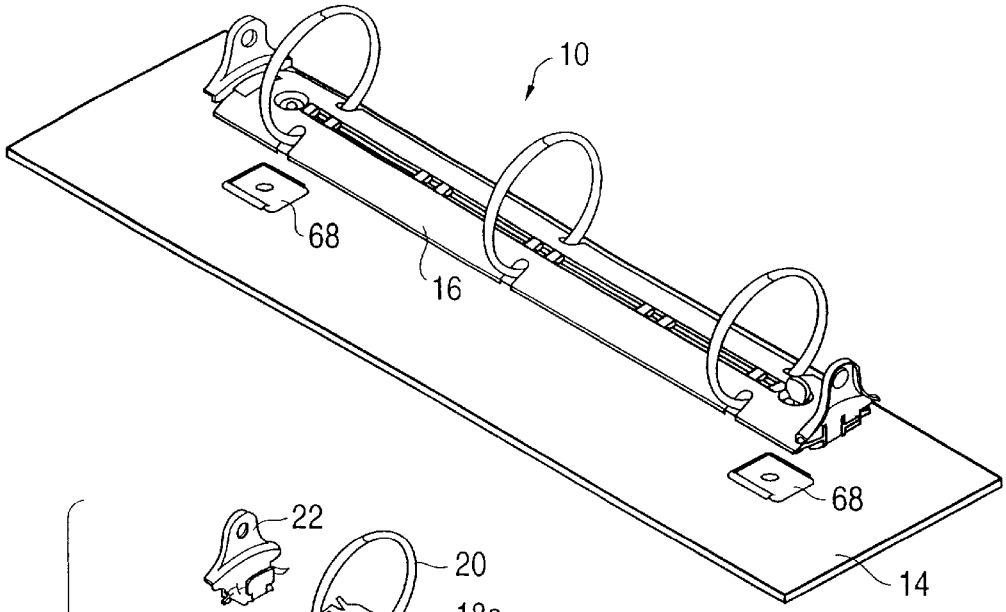
FIG. 9 is a perspective view of the ring binder according to a second embodiment.
Figure 10:
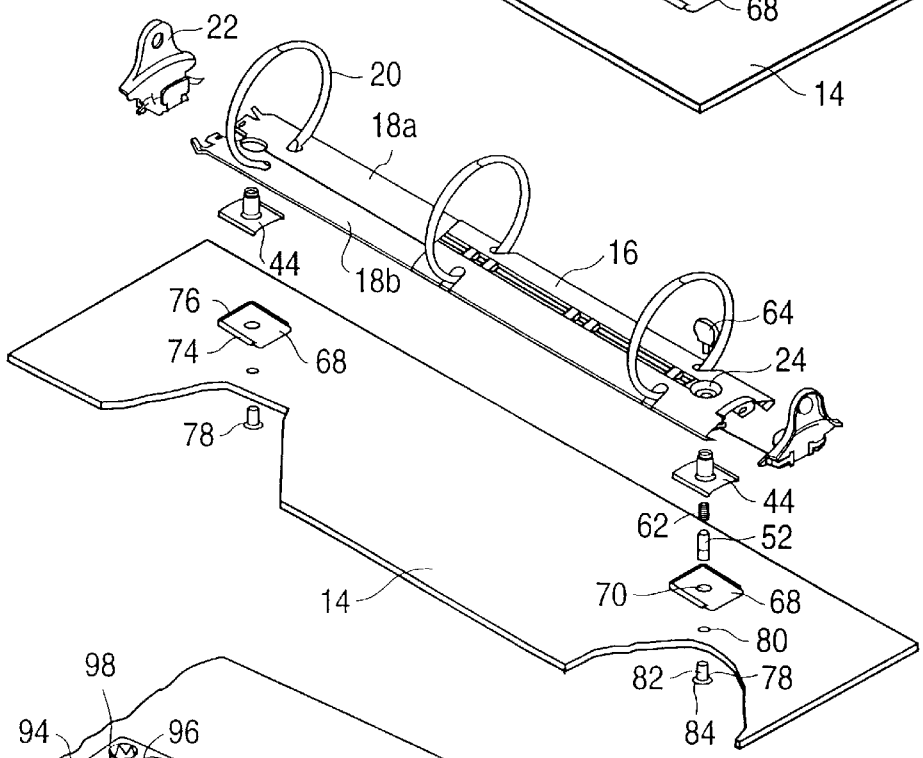
FIG. 10 is a fragmentary exploded perspective view showing the respective elements.

Attachment of the sheet retaining apparatus to the cover member will now be described, with particular reference to FIGS. 3, 7 and 8.

The sheet retaining apparatus 10 is placed at a location such that the base member 44 is adjacent to the plate member 28. The guide rails 50 are aligned between the spaced-apart guide members 30, and the plate member 28 is partially slid along the plate member 28, as shown by arrow 1 in FIG. 7. The knob 64 is pulled upwardly in the direction of arrow 2 shown in FIG. 7, to retract the pin member 52 to a retracted position against the biasing force of the spring 62. The sheet retaining apparatus 10 and the base member 44 are then further slid along the plate member 28 until the base member 44 engages the stop member 34. Thereafter, the knob 64 may be released and will move in the direction of arrow 3 shown in FIG. 8 by the biasing force provided by the spring 62. In this location, the reduced diameter portion 54 of the pin member 52 will enter the aperture 38 in the raised annular protrusion 36 of the plate member 28 to prevent further sliding movement of the base member 44 with respect to the plate member 28, as shown in FIG. 8.

Figure 5:
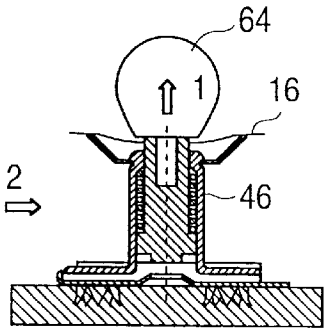
FIGS. 5 and 6 are schematic views showing operation of the pin member to effect a released condition.

The sheet retaining apparatus 10 may be disassembled from the cover member 12 by reversing the above-described steps, and as shown in FIGS. 5 and 6. Briefly, the knob 64 is pulled upwardly in the direction of arrow 1 to retract the pin member 52 and withdraw the reduced diameter portion 54 from its location within the aperture 38. Thereafter, the base member 44 may be slid in the direction of arrow 2 in FIG. 5 until the base member 44 is disengaged from the plate member 28, as shown in FIG. 6. Thereafter, the knob 64 may be released.

Because the base member 44 is moveable orthogonally with respect to reciprocal movement of the pin member 52, and due to the engagement of the reduced diameter portion 54 of the pin member 52 in the aperture 38 of the plate member 28, the base member 44 is prevented from sliding movement with respect to the plate member 28 when the pin member 52 extended and located within the aperture 38.

Figure 4:
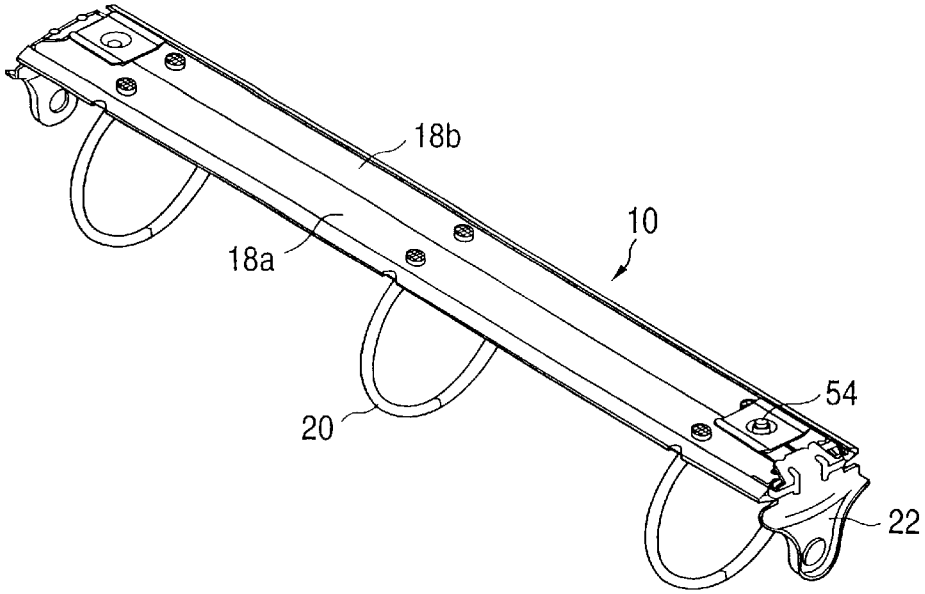
FIG. 4 is a perspective view of the bottom of the sheet retaining apparatus.

As shown in FIG. 2, a pair of plate members 28 and base members 44 are utilized. However, it is only necessary that one of these pairs include the locking function provided by the pin member 52. As shown in FIG. 4, only one of the substantially cylindrical bodies 46 includes a pin member 52 therein. However, a pin member 52 may be located in each of the substantially cylindrical bodies 46 if additional and redundant locking ability is desired.

Figure 16:
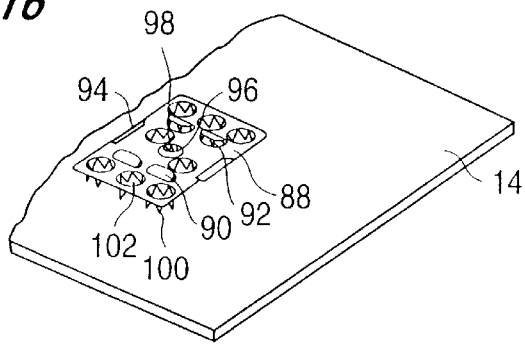
FIG. 16 is a modified form of the plate member shown in FIGS. 1–8.

An alternative embodiment of the plate member 28 of FIG. 2 is shown in FIG. 16. A pair of spaced-apart plate members 88 are secured to the spine 14 of the cover member 12 in the same manner as the plate members 28 described above. Each of the plate members 88 includes a pair of spaced-apart guide members 90 which form guide channels 92. The plate members 88 each further include a stop member 94.

Located approximately centrally of the plate member 88 is a raised annular protrusion 96 having an aperture 98 therein. Depending from a lower surface of the plate member 88 are arranged a plurality of deformable claws 100 arranged around the periphery of a plurality of holes 102 formed in the plate member 88. In the embodiment shown in FIG. 16, eight holes 102 are located in the plate member 88, however, any suitable number may be utilized.

When the plate member 88 is assembled with the spine 14 of the cover member 12, the plate member 88 is pressed against the spine 14 such that the deformable claws 100 dig into the material which forms the spine. The deformable claws 100 extend outwardly somewhat in order to securely fasten the plate member 88 to the spine 14.

The embodiment shown in FIG. 16 operates the same as the plate member 28 shown in FIG. 2, and is engagable by the base member 44 of the sheet retaining apparatus 10 in the same manner. However, the wider dimension of the plate member 88 compared with the plate member 28, along with the use of a greater number of holes 102 with deformable claws 100, results in a more secure attachment of the plate member 88 to the spine 14 which is suitable for larger ring binders.

As shown in FIG. 3, the deformable claws 40 do not extend completely through and penetrate the outer surface 14*b* of the spine 14. Thus, the deformable claws 40 are concealed from the outer surface 14*b* of the cover member 12 to provide a visually pleasing appearance. However, if this is not desired, an alternative arrangement for attaching the base member 44 to the spine 14 is shown in FIGS. 9–15.

Figure 11:
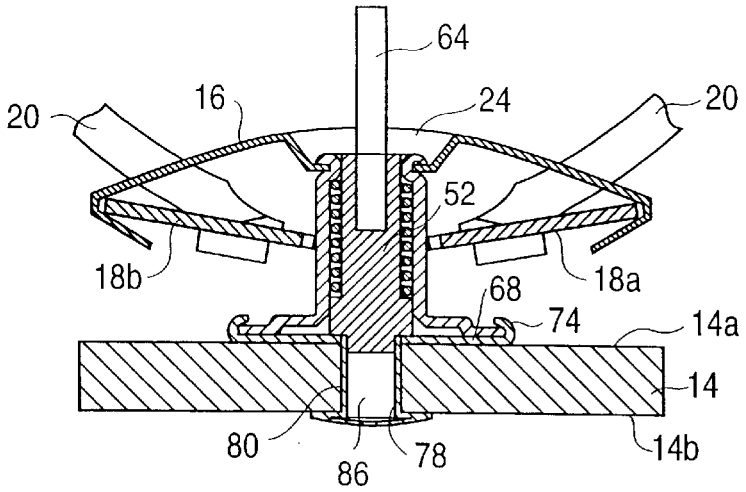
FIG. 11 is a fragmentary end view showing the ring binder in an assembled condition.
Figure 12:
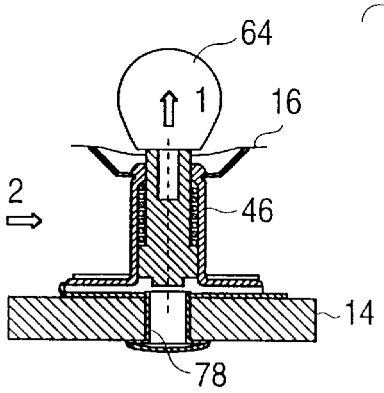
FIGS. 12 and 13 are schematic views showing operation of the pin member to effect a released condition.
Figure 13:
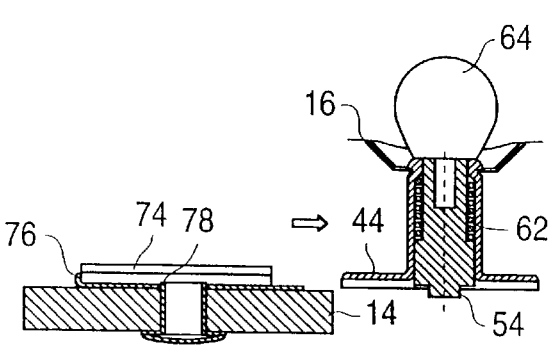
Figure 14:
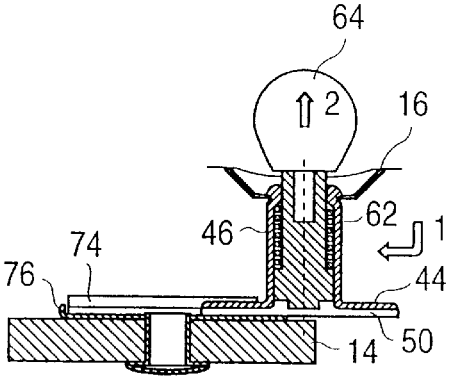
FIGS. 14 and 15 are schematic views showing operation of the pin member to effect an assembled condition.
Figure 15:
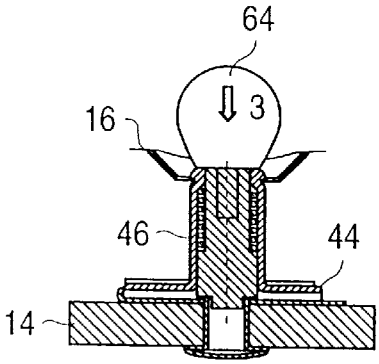

As shown in FIG. 11, the plate member 68 does not include a plurality of the deformable claws 40 like the plate member 28 shown in FIG. 3. Further, the plate member 68 does not include the raised annular protrusion 36 like the plate member 28 shown in FIGS. 2 and 6.

The plate member 68 includes an aperture 70 which is similar to the aperture 38 provided in plate member 28, except that it is slightly larger in diameter. Further, the plate member 68 includes a pair of spaced-apart guide members 72 which form guide channels 74, and a stop member 76, all similar to the respective elements described previously with respect to the plate member 28 of the first embodiment.

The plate member 68 is secured to the inner surface 14*a* of the spine 14 by a hollow rivet 78. The rivet 78 extends through a hole 80 in the spine 14. The hollow rivet 78 includes a hollow tubular portion 82 which is insertable through the hole 80 in the spine 14 and into the aperture 70 in the plate member 68. A head 84 on the rivet 78 engages the outer surface 14*b* of the spine 14. Thereafter, the end of the hollow tubular portion 82 of the rivet 78 may be deformed, for example, by pressing, to flare the end thereof outwardly over the surface of the plate member 68 surrounding the aperture 70, to securely fasten the plate member 68 to the spine 14 of the cover member 12.

The hollow tubular portion 82 of the rivet 78 forms a bore 86 into which the reduced diameter portion 54 of the pin member 52 may enter.

The elements which make up the sheet retaining apparatus 10 and the associated base member 44 and pin member 52 are the same in FIGS. 9–15 as those shown in FIGS. 1–8. Assembly and disassembly of the sheet retaining apparatus 10 to the spine 14 is the same in the embodiment of FIGS. 9–15 as that shown in FIGS. 1–8. Thus, the sheet retaining apparatus 10 may be interchangeably connected to the plate member 28 shown in FIG. 2 or the plate member 68 shown in FIG. 10.

The above described arrangement provides a fastener assembly for releasably fastening the sheet retaining apparatus to the cover member to form a ring binder, whereby the sheet retaining apparatus may be repeatedly assembled and disassembled with the cover member. Further, because the sheet retaining apparatus is readily assemble and disassemble from the cover member, it is possible to ship the ring binder to the consumer with the sheet retaining apparatus disassembled from the cover member, thereby allowing the respective elements to be efficiently and densely packaged.

A plurality of cover members and sheet retaining apparatuses may be packaged together while in an unassembled condition to form a kit for producing ring binders. Instructions may be provided as necessary for conveying information regarding the assembly and disassembly of the sheet retaining apparatus to and from the cover member. The instructions may be provided on a separate sheet or may be placed directly onto a surface of the cover member or sheet retaining apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A binder assembly comprising:

a cover member;

a sheet retaining apparatus; and a fastener assembly for releasably fastening said sheet retaining apparatus to said cover member, said fastener assembly comprising:

a plate member secured to said cover member, said plate member having an aperture therein; and a pin member reciprocally mounted to said sheet retaining apparatus, said pin member being selectively movable between an engaged position where a portion of said pin member is positioned in said aperture of said plate member to secure said sheet retaining apparatus to said cover member, and a release position where said portion of said pin is not positioned in said aperture of said plate member to remove said sheet retaining apparatus from said cover member.

2. The binder assembly as set forth in claim 1, wherein said sheet retaining apparatus has a plurality of rings for engaging corresponding holes in sheets of material retained by said sheet retaining apparatus.

3. The binder assembly as set forth in claim 1, wherein said plate member includes a pair of spaced-apart guide members which form guide channels, and wherein said sheet retaining apparatus includes a base member having a pair of spaced-apart guide surfaces slidable within said guide channels.

4. The binder assembly as set forth in claim 3, wherein said base member is movable orthogonally with respect to reciprocal movement of said pin member.

5. The binder assembly as set forth in claim 3, wherein said pin member prevents sliding movement of said base member with respect to said plate member when said pin member is located within said aperture.

6. The binder assembly as set forth in claim 1, wherein said sheet retaining apparatus includes a substantially cylindrical body member attached thereto for housing said pin member therein.

7. The binder assembly as set forth in claim 1, further comprising a spring for biasing said pin member in a direction away from said sheet retaining apparatus.

8. The binder assembly as set forth in claim 1, further comprising a knob attached to said pin member for engagement by a user to move said pin member to a release position where said portion of said pin member is disengaged from said aperture.

9. The binder assembly as set forth in claim 1, further comprising a second plate member secured to said cover member, and wherein said sheet retaining apparatus includes a pair of spaced-apart base members slidably engageable with corresponding ones of said plate members.

10. The binder assembly as set forth in claim 1, wherein said plate member includes a plurality of deformable claw members depending therefrom and engaging said cover member.

11. The binder assembly as set forth in claim 10, wherein said claw members are concealed from an outer surface of said cover member.

12. The binder assembly as set forth in claim 1, further comprising a rivet extending through said cover member and through said aperture in said plate member, said rivet having a bore therein for receiving said portion of said pin member therein.

13. A ring binder assembly comprising:

a cover member having a front cover, a back cover, and a spine located between said back cover and said front cover;

a plate member secured to said cover member, said plate member having an aperture therein;

a sheet retaining apparatus; and a pin member movably attached to said sheet retaining apparatus, said pin member being selectively movable between an engaged position where a portion of said pin member is positioned within said aperture and said sheet retaining apparatus is attached to said cover member, and a release position where said portion of said pin member is not positioned in said aperture and said sheet retaining apparatus is removable from said cover member.

14. The ring binder assembly as set forth in claim 13, wherein said sheet retaining apparatus has a plurality of rings for engaging corresponding holes in sheets of material retained by said sheet retaining apparatus.

15. The ring binder assembly as set forth in claim 13, wherein said plate member includes a pair of spaced-apart guide members which form guide channels, and wherein said sheet retaining apparatus includes a base member having a pair of spaced-apart guide surfaces slidable within said guide channels.

16. The ring binder assembly as set forth in claim 15, wherein said base member is movable orthogonally with respect to reciprocal movement of said pin member.

17. The ring binder assembly as set forth in claim 15, wherein said pin member prevents sliding movement of said base member with respect to said plate member when said pin member is located within said aperture.

18. The ring binder assembly as set forth in claim 13, wherein said sheet retaining apparatus includes a substantially cylindrical body member attached thereto for housing said pin member therein.

19. The ring binder assembly as set forth in claim 18, further comprising a spring for biasing said pin member in a direction away from said sheet retaining apparatus.

20. The ring binder assembly as set forth in claim 18, further comprising a knob attached to said pin member for engagement by a user to move said pin member to a release position where said portion of said pin member is disengaged from said aperture.

21. The ring binder assembly as set forth in claim 13, further comprising a second plate member secured to said cover member, and wherein said sheet retaining apparatus includes a pair of spaced-apart base members slidably engageable with corresponding ones of said plate members.

22. The ring binder assembly as set forth in claim 13, wherein said plate member includes a plurality of deformable claw members depending therefrom and engaging said cover member.

23. The ring binder assembly as set forth in claim 22, wherein said claw members are concealed from an outer surface of said cover member.

24. The ring binder assembly as set forth in claim 13, further comprising a rivet extending through said cover member and through said aperture in said plate member, said rivet having a bore therein for receiving said portion of said pin member therein.

25. The ring binder assembly as set forth in claim 13, wherein said plate member is secured to said spine.

26. A kit for producing a ring binder comprising:

a cover member having a plate member secured thereto, said plate member having an aperture therein, said plate member further having a pair of spaced-apart guide channels; and a sheet retaining apparatus separate from said cover member, said sheet retaining apparatus including a base member having a pair of spaced-apart guide surfaces, said sheet retaining apparatus further including a pin member reciprocally mounted thereto.

27. The kit for producing a ring binder as set forth in claim 26, further comprising instructions for conveying information regarding the assembly and disassembly of the sheet retaining apparatus to and from said cover member.

28. The kit for producing a ring binder as set forth in claim 26, wherein a plurality of said cover members and said sheet retaining apparatuses are packaged together while in an unassembled condition.

* * * * *